US010117472B2

(12) United States Patent
Robbins

(10) Patent No.: US 10,117,472 B2
(45) Date of Patent: Nov. 6, 2018

(54) GLOVE HAVING A SPLIT WRIST WRAP

(71) Applicant: Fit Four, LLC, Bountiful, UT (US)

(72) Inventor: Jonathan D Robbins, Bountiful, UT (US)

(73) Assignee: Fit Four, LLC, Bountiful, UT (US)

( * ) Notice: Subject to any disclaimer, the term of this patent is extended or adjusted under 35 U.S.C. 154(b) by 74 days.

(21) Appl. No.: 15/346,588

(22) Filed: Nov. 8, 2016

(65) Prior Publication Data

US 2018/0110270 A1 Apr. 26, 2018

Related U.S. Application Data

(60) Provisional application No. 62/410,731, filed on Oct. 20, 2016.

(51) Int. Cl.
*A41D 19/015* (2006.01)
*A41D 19/00* (2006.01)
*A41F 1/06* (2006.01)

(52) U.S. Cl.
CPC ..... *A41D 19/0048* (2013.01); *A41D 19/00* (2013.01); *A41D 19/0013* (2013.01); *A41F 1/06* (2013.01); *A41D 2300/32* (2013.01)

(58) Field of Classification Search
CPC ..... A41D 19/01582; A41D 19/01547; A41D 2600/104; A41D 13/0005; A41D 13/081; A41D 13/088; A41D 19/0044; A41D 19/01523; A41D 19/01576; A41F 1/06; A61B 5/02438; A61B 5/6806; A45F 2005/008; A63B 71/141; A63B 71/14; A63B 2071/0663; A63B 2244/09; A63B 24/0006; A63B 24/0062; A63B 2209/10; A63B 23/00; A63B 24/0075; A63B 69/0046; A63B 71/00; A63B 71/06; A63B 71/0669; A63B 71/143; A62B 17/001
See application file for complete search history.

(56) References Cited

U.S. PATENT DOCUMENTS 3,938,207 A * 2/1976 Drescher ..... A63B 31/04 441/57
4,138,108 A * 2/1979 Robinson ..... A63B 71/14 2/170
4,198,709 A * 4/1980 Clayton ..... A41D 13/088 2/161.7
4,525,877 A * 7/1985 Chong ..... A63B 71/148 2/161.1
4,531,241 A * 7/1985 Berger ..... A41D 19/01523 2/159

(Continued)

*Primary Examiner* — Bobby Muromoto, Jr.
(74) *Attorney, Agent, or Firm* — Kirton McConkie; Brian Tucker

(57) ABSTRACT

A glove can include an integrated wrist wrap that is split to allow a watch to be worn with the glove. The glove comprises a hand portion within which a wearer's hand is placed and a wrist wrap attached to a proximal edge of the hand portion and configured to extend around the wearer's wrist when the wearer's hand is placed in the hand portion. The wrist wrap can include a slit that extends lengthwise within the wrist wrap. When the wearer is also wearing a watch, the watch can be inserted through the slit so that the wrist wrap will be positioned on each side of the watch thereby allowing the face of the watch to remain visible while still providing support to the wrist. A split wrist wrap without a hand portion is also provided.

20 Claims, 5 Drawing Sheets

(56) References Cited

U.S. PATENT DOCUMENTS 4,608,720 A * 9/1986 Purin ..... A63B 69/0046 2/161.1
4,905,321 A * 3/1990 Walunga ..... A41D 19/01582 2/160
4,906,025 A * 3/1990 Schreindl ..... A44C 5/0046 224/219
4,958,384 A * 9/1990 McCrane ..... A41D 19/01582 2/161.6
5,033,119 A * 7/1991 Wiggins ..... A41D 19/01582 2/161.3
5,341,972 A * 8/1994 Jacks ..... A45C 1/04 224/165
5,517,694 A * 5/1996 Fabry ..... A41D 19/01582 2/161.1
5,555,561 A * 9/1996 Plachta ..... A41D 13/0005 2/270
5,557,806 A * 9/1996 Caswell ..... A41D 19/01547 2/161.1
5,592,694 A * 1/1997 Yewer, Jr. ..... A41D 13/081 2/161.1
5,689,828 A * 11/1997 Mah ..... A63B 71/148 2/16
6,126,572 A * 10/2000 Smith ..... A63B 21/002 482/4
6,443,341 B1 * 9/2002 Rittmann ..... A45C 1/04 150/149
6,850,162 B2 * 2/2005 Cacioli ..... G01M 3/027 2/159
7,041,032 B1 * 5/2006 Calvano ..... A63B 26/00 368/41
7,616,098 B2 * 11/2009 Al-Sabah ..... A63B 71/0605 340/323 R
7,887,492 B1 * 2/2011 Rulkov ..... A61B 5/01 600/479
7,971,710 B1 * 7/2011 Zaher ..... A63B 71/0672 206/216
8,276,298 B2 * 10/2012 Padgett ..... A44C 5/0069 283/75
9,067,123 B1 * 6/2015 Robbins ..... A63B 71/141
D770,690 S * 11/2016 Robbins ..... D2/617
2007/0000019 A1 * 1/2007 Nascimento ..... A41F 1/06 2/161.1

* cited by examiner

GLOVE HAVING A SPLIT WRIST WRAP

CROSS-REFERENCE TO RELATED APPLICATIONS

This application claims the benefit of U.S. Provisional Application No. 62/410,731 which was filed on Oct. 20, 2016.

BRIEF SUMMARY

The present invention is generally directed to a glove that includes an integrated wrist wrap that is split to allow a watch to be worn with the glove. The glove comprises a hand portion within which a wearer's hand is placed and a wrist wrap attached to a proximal edge of the hand portion and configured to extend around the wearer's wrist when the wearer's hand is placed in the hand portion. The wrist wrap can include a slit that extends lengthwise within the wrist wrap. When the wearer is also wearing a watch, the watch can be inserted through the slit so that the wrist wrap will be positioned on each side of the watch thereby allowing the face of the watch to remain visible while still providing support to the wrist.

In one embodiment, the present invention is implemented as a glove having a hand portion within which a wearer's hand is placed, and a wrist wrap having a first end that is attached along a proximal edge of the hand portion and a second end that is configured to extend around the wearer's wrist when the wearer's hand is placed in the hand portion. The wrist wrap includes a slit that extends lengthwise within the wrist wrap.

In another embodiment, the present invention is implemented as a wrist wrap having a first end and a second end. The wrist wrap includes: two strips of material that are positioned side-by-side; a first one or more connector pieces that overlay and secure the two strips of material at the first end and a second one or more connector pieces that overlay and secure the two strips of material at the second end such that a slit is formed between the two strips of material; and a first securement piece coupled at the first end and a second securement piece coupled at the second end. The first securement piece is configured to retain the second securement piece when the wrist wrap is wrapped around a wearer's wrist. The slit forms an opening through which the wearer's watch can extend while the wrist wrap is wrapped around the wearer's wrist.

This summary is provided to introduce a selection of concepts in a simplified form that are further described below in the Detailed Description. This Summary is not intended to identify key features or essential features of the claimed subject matter.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

The present invention is generally directed to a glove that can be worn to provide protection to the hand as well as support to the wrist. It is common to wear gloves while performing certain activities such as various types of exercise (e.g., weight lifting or obstacle races) or manual labor. It is also becoming common to employ various types of wearable devices while performing these activities. For example, a user may employ his smart phone or a fitness watch or band (hereinafter "watch") to track his or her performance during an activity. Oftentimes, it is desirable to have wrist support during such activities. The glove of the present invention allows the user to support his or her wrists while also accommodating the use of a watch.

Figure 1:
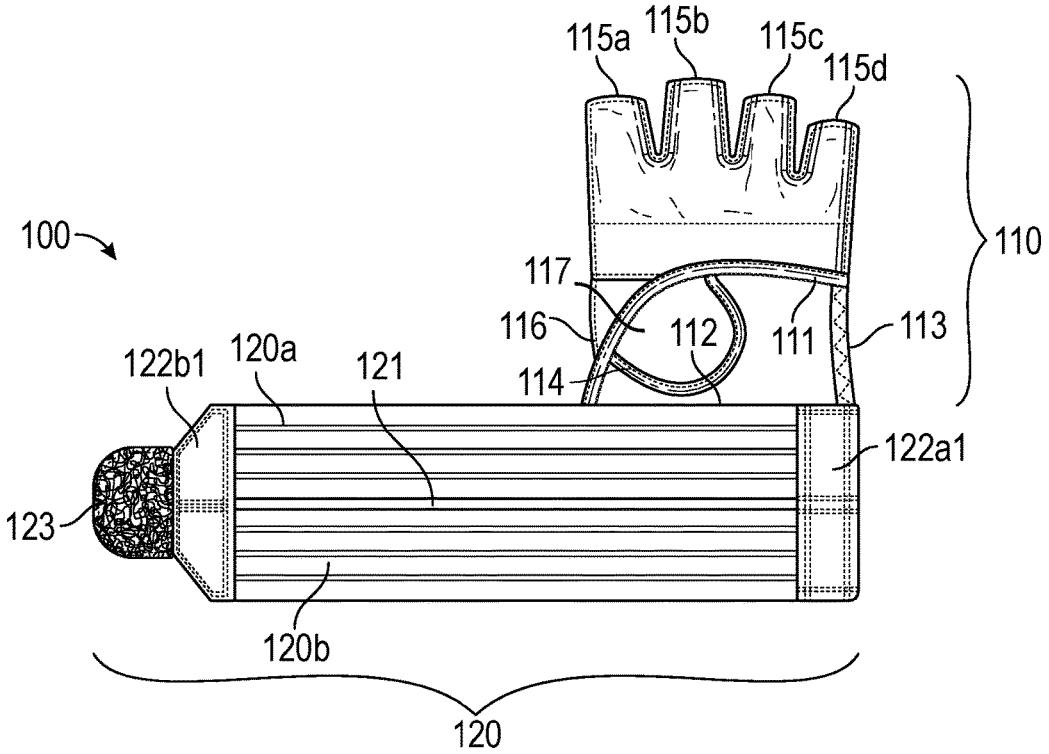
FIG. 1 illustrates the back side of a right-handed glove with a split wrist wrap in accordance with one or more embodiments of the present invention.
Figure 2:
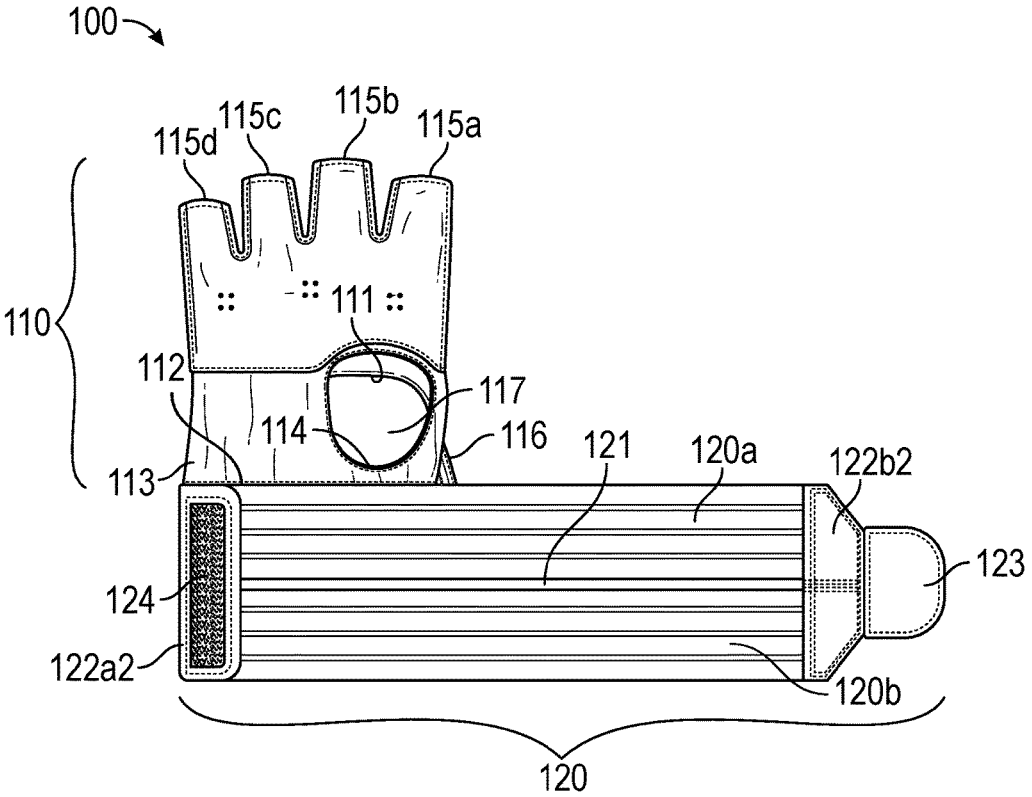
FIG. 2 illustrates the front side of the glove of FIG. 1.
Figure 3:
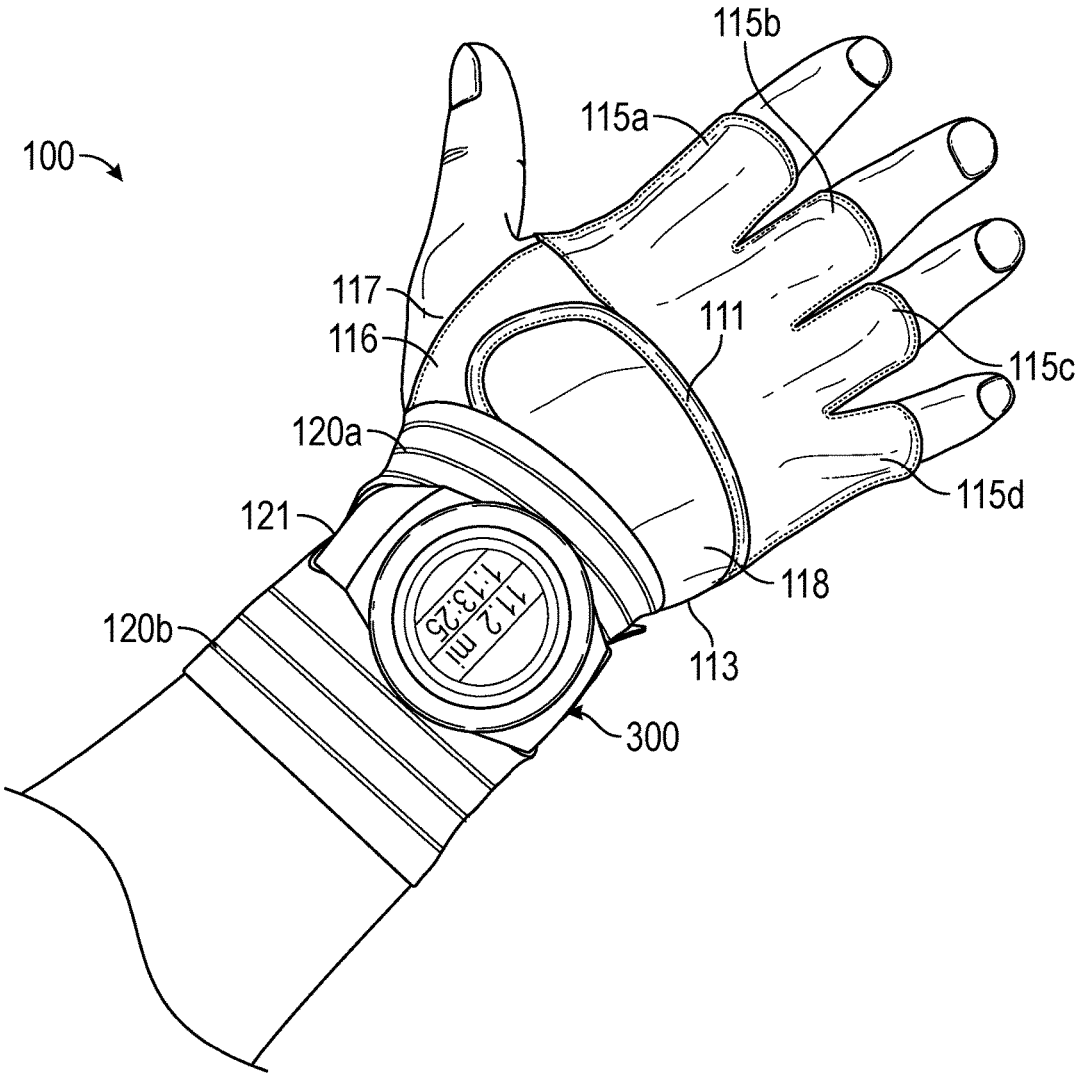
FIG. 3 illustrates the glove of FIGS. 1 and 2 being worn with a watch.
Figure 4:
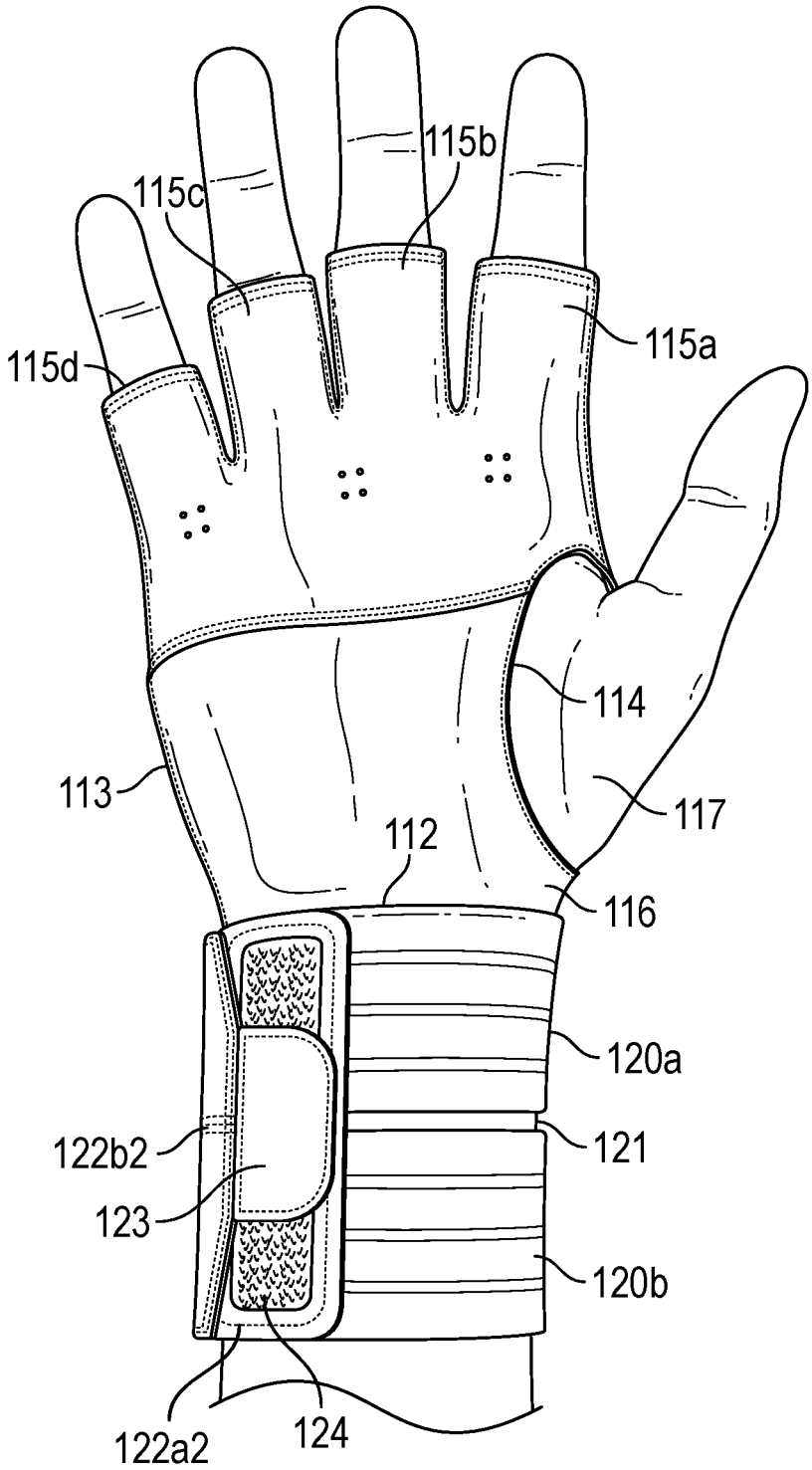
FIG. 4 also illustrates the glove of FIGS. 1 and 2 being worn with a watch.

FIGS. 1-4 illustrate various views of a glove 100 that includes a split wrist wrap in accordance with one or more embodiments of the present invention. FIGS. 1 and 2 illustrate a back-side view and a front-side view respectively of glove 100 when not worn, while FIGS. 3 and 4 illustrate a back-side view and a front-side view respectively of glove 100 being worn on the right hand.

Glove 100 comprises a hand portion 110 and a wrist wrap 120. A portion of wrist wrap 120 is connected along a front-side (or palm-side) proximal edge 112 of hand portion 110. Front-side proximal edge 112 can be configured so that it extends along the base of the wearer's palm at or near the wrist joint. The portion of wrist wrap 120 that is not connected to hand portion 110 can be wrapped around the wearer's wrist.

Hand portion 110 includes four open-ended sheaths 115*a*-115*d* at a distal end of the glove through which the wearer's fingers extend. The length of open-ended sheaths 115*a*-115*d* can be configured so that the open-ended sheaths do not cover the intermediate phalanges (e.g. so that they extend up to the second knuckle). However, in some embodiments, open-ended sheaths 115*a*-115*d* can extend at least partially over the intermediate phalanges.

Although glove 100 includes four open-ended sheaths, in some embodiments, a workout glove can contain less than four open-ended sheaths. For example, a glove can be configured with only open-ended sheaths 115*a*, 115*b* (i.e., one for the index finger and one for the middle finger). Other arrangements of fewer than four open-ended sheaths can also be used. In embodiments where fewer than four open-ended sheaths are employed, hand portion 110 can include an opening for one or more of the fingers for which no open-ended sheath is provided. For example, if open-ended sheaths are provided for the index and middle fingers only, the ring and pinky fingers may extend out through a single opening.

Also, in some embodiments, the length of one open-ended sheath may be different than the length of another open-ended sheath. For example, an open-ended sheath for the middle finger may extend up to the second knuckle while an open-ended sheath for the ring finger may extend only half way over the proximal phalange.

Hand portion 110 also includes a thumb opening 117. Thumb opening 117 is configured so that the entire thumb remains exposed. In some embodiments, thumb opening 117 may be configured so that a portion of the wearer's palm is also exposed. For example, as best shown in FIG. 4, an inside edge 114 of hand portion 110 may curve inwardly as it extends downwardly thereby exposing a portion of the palm at the base of the thumb. To create thumb opening 117, hand portion 110 may include a strip 116 that is configured to extend from back-side proximal edge 111 and wrap around the base of the thumb where it connects to front-side proximal edge 112.

In some embodiments of a glove, such as glove 100, a back-side proximal edge 111 does not extend as far down the hand as front-side proximal edge 112. In such cases, a portion of the back side of the wearer's hand remains uncovered. For example, back-side proximal edge 111 can be configured so that it is positioned near the wearer's knuckles (i.e. the metacarpophalangeal joints). In such cases, the back side of the glove can cover the wearer's knuckles while leaving a majority of the back side of the hand uncovered.

For example, as shown in FIG. 3, an opening 118 is formed between back-side proximal edge 111 and wrist wrap 120 with strip 116 being the only portion of hand portion 110 that extends along the back side of the hand to back-side proximal edge 111. In such embodiments, an outer edge 113 of hand portion 110 does not wrap around to the back side of the wearer's hand. In contrast, in some embodiments, outer edge 113 may wrap around to the back side of the wearer's hand.

In embodiments of the invention, hand portion 110 can be formed of multiple materials. For example, a front or palm side of hand portion 110 can be formed of a leather material while a back side of hand portion 110 can be formed of a spandex or other elastic material. Employing a leather or similar material on the palm side can provide a strong, long-lasting material to aid in preventing blisters or calluses while working out, while employing an elastic material such as spandex on the back side increases the comfort and wearability of the glove.

In some embodiments, different materials can be employed on the palm side of hand portion 110. As stated above, a leather or similar material can be used over the knuckles to prevent blisters or calluses during workout while an elastic material may be connected to the leather material at a location below the knuckles and extend along the palm down to front-side proximal edge 112. Typically, wrist wrap 120 can be formed of an elastic material; however, non-elastic materials can also be used.

Wrist wrap 120 can include a slit 121 that extends lengthwise within the wrap thereby forming an opening through which a watch can extend when a user wears glove 100 with a watch. In some embodiments, slit 121 may be positioned centrally within the width of wrist wrap 120 so that equal widths of the wrap will be positioned on each side of the watch such as is shown in FIG. 3.

Figure 5:
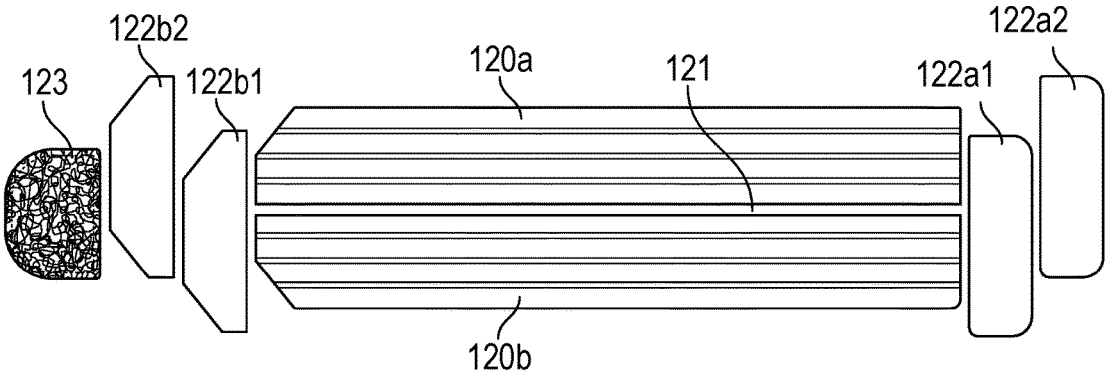
FIG. 5 provides an exploded view of the wrist wrap.

In some embodiments, slit 121 may be formed by employing two individual strips of material 120*a*, 120*b*. For example, as best shown in FIG. 5, strips 120*a*, 120*b* can be positioned side-by-side and then two pairs of connector pieces 122*a*1/122*a*2 and 122*b*1/122*b*2 can be secured (e.g., by sewing) across opposite ends of the strips thereby fixing the relative positions of the strips. Connector pieces 122*a*1, 122*b*1 can be secured on an inside of wrist wrap 120 while connector pieces 122*a*2, 122*b*2 can be secured on an outside of wrist wrap 120. Although pairs of connector pieces are shown, a single connector piece may be employed on each end in some embodiments. By connecting strips 120*a*, 120*b* together at their ends using connector pieces 122*a*1/122*a*2, 122*b*1/122*b*2, the stretchability of wrist wrap 120 will not be adversely impacted. Alternatively, wrist wrap 120 could be formed of a single strip of material having a slit formed through the material that extends partially along its length.

Securement pieces 123, 124 can also be secured at opposite ends of wrist wrap 120. Securement pieces 123, 124 may typically comprise hook and loop material as is depicted in the figures. However, any other means of coupling the securement pieces together may be employed (e.g., buttons, snaps, cinch straps, etc.). In some embodiments, securement piece 123 can extend from either or both connector pieces 122*b*1, 122*b*2 while securement piece 124 can be coupled to or incorporated into connector piece 122*a*2.

In the depicted embodiment, connector piece 122*a*1, connector piece 122*a*2 into which securement piece 124 is incorporated, and the corresponding end of wrist wrap 120 substantially align with outer edge 113 as is best shown in FIGS. 1 and 2 such that the free end of wrist wrap 120 extends inwardly from hand portion 110. By positioning securement piece 124 on the inside (or palm side) of wrist wrap 120, securement piece 123 will be positioned towards the underside of the wrist when securement piece 123 is coupled to securement piece 124 thereby ensuring that slit 121 will be positioned overtop watch 300 as shown in FIGS. 3 and 4 (i.e., ensuring that securement piece 123 and connector pieces 122*b*1/122*b*2 are not positioned overtop watch 300). Further, by aligning securement piece 124 with outer edge 113, securement piece 123 will be positioned towards the outside of the wrist where it is less likely to interfere with any activities. It is to be understood, however, that wrist wrap 120 can also be coupled to hand portion 110 in other orientations.

In some embodiments, the length of wrist wrap 120 can be at least 300 mm (~11.8 inches) to ensure that it can be wrapped around the wrist twice. For example, a small-sized glove may have a wrist wrap that is 310 mm (~12.2 inches) long and a large-sized glove may have a wrist wrap that is 360 mm (~14.2 inches) long. The lengths of securement pieces 123, 124 can also be sufficient to provide flexibility in their placement to accommodate different wrist sizes. For example, the length of securement piece 124 may be 32 mm (~1.25 inches) while the length of securement piece 123 may be 50 mm (~2 inches). Also, in some embodiments, the overall width of wrist wrap 120 may be approximately 76 mm (∞3 inches).

Figure 6:
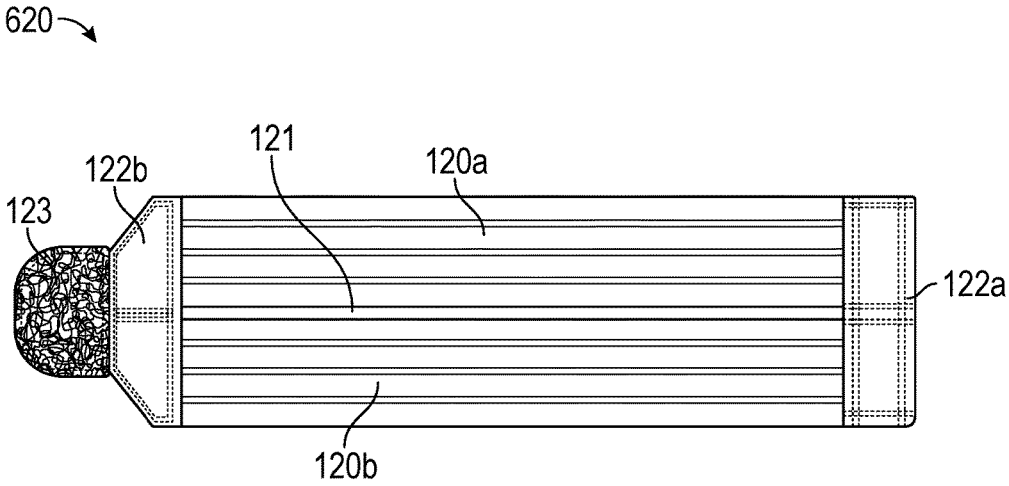
FIG. 6 illustrates a wrist wrap in isolation.

In some embodiments of the present invention, as is shown in FIG. 6, a wrist wrap 620 may be provided without a hand portion. Wrist wrap 620 can be configured in the same manner as wrist wrap 120 but would not be coupled to a proximal edge of a glove. A user may elect to wear wrist wrap 620 while wearing a watch and when it is only desired to have wrist support. Alternatively, wrist wrap 620 may be worn with an independent glove that does not include a wrist wrap.

Figure 7:
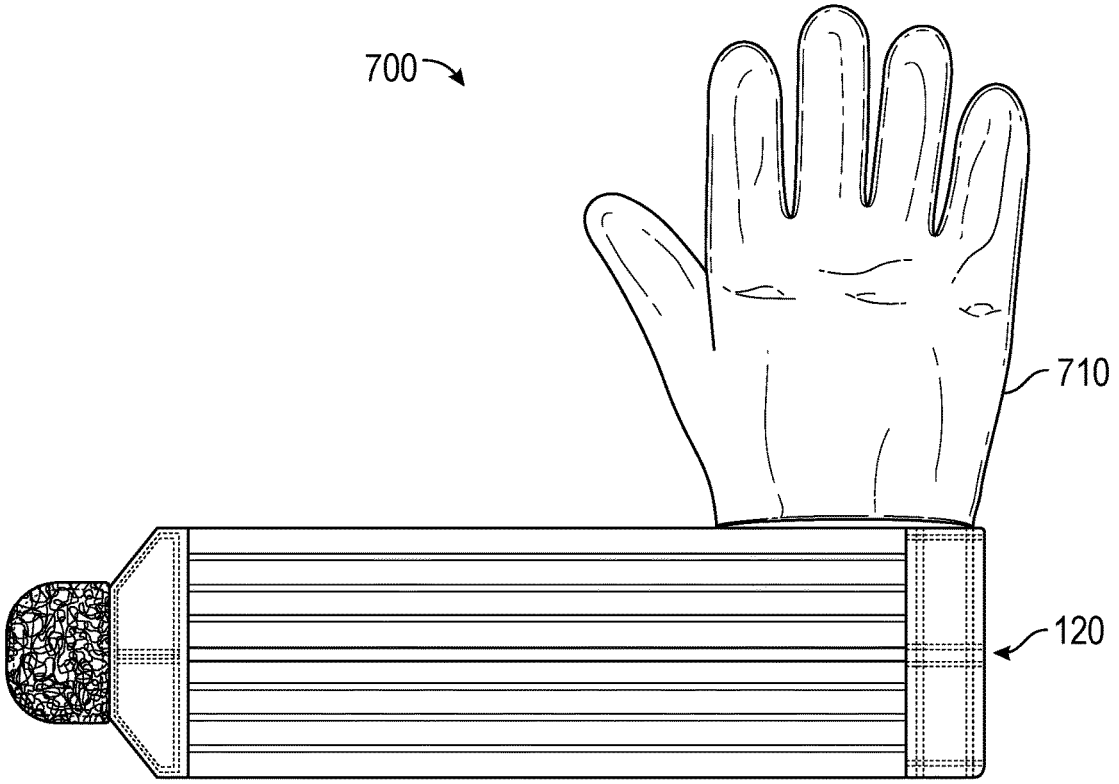
FIG. 7 illustrates another glove with a split wrist wrap.

FIG. 7 illustrates a glove 700 that includes a full hand portion 710 and wrist wrap 120 that is coupled to hand portion 710 along a proximal edge. FIG. 7 is intended to represent that wrist wrap 120 could be employed on any type of glove to allow the glove and a watch to be worn at the same time.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed:

1. A glove comprising:

a hand portion within which a wearer's hand is placed; and a supportive wrist wrap having a first end that is attached to the hand portion and a second end that is configured to extend around the wearer's wrist when the wearer's hand is placed in the hand portion;

wherein the wrist wrap includes a slit that extends through the wrist wrap and lengthwise within the wrist wrap, the slit enabling a watch being worn on the wearer's wrist to extend through the wrist wrap while the wrist wrap extends around the wearer's wrist to provide support to the wrist thereby allowing the wearer to view a face of the watch while wearing the glove.

2. The glove of claim 1, wherein the wrist wrap comprises two strips of material that are positioned side-by-side and connected together at the first and second ends to thereby form the slit.

3. The glove of claim 2, wherein the strips are connected together using at least one connector piece at each of the first and second ends, each connector piece overlaying both strips.

4. The glove of claim 3, wherein the at least one connector piece at each of the first and second ends comprises a pair of connector pieces at each of the first and second ends, the connector pieces in each pair being secured on opposite sides of the wrist wrap.

5. The glove of claim 1, further comprising:

a first securement piece that is positioned at the first end of the wrist wrap; and a second securement piece that is positioned at the second end of the wrist wrap.

6. The glove of claim 5, wherein the wrist wrap comprises two strips of material that are positioned side-by-side and connected together at the first and second ends to thereby form the slit, and wherein the strips are connected together using at least one connector piece at each of the first and second ends, each connector piece overlaying both strips, and wherein the first securement piece is coupled to the at least one connector piece at the first end and the second securement piece is coupled to the at least one connector piece at the second end.

7. The glove of claim 6, wherein the at least one connector piece at each of the first and second ends comprises a pair of connector pieces at each of the first and second ends, the connector pieces in each pair being secured on opposite sides of the wrist wrap.

8. The glove of claim 7, wherein the first securement piece is incorporated into one of the connector pieces at the first end and the second securement piece extends from one or both of the connector pieces at the second end.

9. The glove of claim 1, wherein the wrist wrap is formed of a single strip of material within which the slit is formed.

10. The glove of claim 1, wherein the wrist wrap is at least 300 mm long.

11. The glove of claim 1, wherein the hand portion includes an outer edge, and wherein the first end of the wrist wrap aligns with the outer edge.

12. The glove of claim 1, wherein the wrist wrap is attached along a front-side proximal edge of the hand portion.

13. The glove of claim 1, wherein the hand portion includes a thumb opening that exposes the wearer's thumb and one or more open-ended sheaths through which corresponding one or more of the wearer's fingers extend.

14. The glove of claim 1, wherein the slit is centered within a width of the wrist wrap.

15. The glove of claim 1, wherein the first end of the wrist wrap is attached to a front-side of the hand portion.

16. A supportive wrist wrap having a first end and a second end, the supportive wrist wrap comprising:

two strips of elastic material that are positioned side-by-side;

a first one or more connector pieces that overlay and secure the two strips of material at the first end and a second one or more connector pieces that overlay and secure the two strips of material at the second end such that a slit is formed between the two strips of material; and a first securement piece coupled at the first end and a second securement piece coupled at the second end, the first securement piece configured to retain the second securement piece when the wrist wrap is wrapped around a wearer's wrist, the slit forming an opening through which the wearer's watch can extend while the wrist wrap is wrapped around the wearer's wrist.

17. The wrist wrap of claim 16, wherein the first one or more connector pieces comprise a first pair of connector pieces positioned on opposite sides of the first end and the second one or more connector pieces comprise a second pair of connector pieces positioned on opposite sides of the second end.

18. The wrist wrap of claim 17, wherein the first securement piece extends from the first pair of connector pieces, and the second securement piece is coupled to or incorporated into one of the second pair of connector pieces.

19. The wrist wrap of claim 16, wherein the two strips of material have a length of at least 300 mm.

20. The wrist wrap of claim 16, further comprising:

a hand portion coupled to the wrist wrap along a portion of one of the strips of material, the hand portion configured to receive the wearer's hand while the wrist wrap is wrapped around the wearer's wrist.

* * * * *